US007438140B2

(12) United States Patent
Sterling et al.

(10) Patent No.: US 7,438,140 B2
(45) Date of Patent: Oct. 21, 2008

(54) SHOCK ATTENUATING DEVICE FOR A ROTARY IMPACT TOOL

(75) Inventors: Robert E. Sterling, Spokane, WA (US); Matthew R. Sterling, Spokane, WA (US)

(73) Assignee: Exhaust Technologies, Inc., Spokane, WA (US)

( * ) Notice: Subject to any disclaimer, the term of this patent is extended or adjusted under 35 U.S.C. 154(b) by 0 days.

(21) Appl. No.: 11/655,588

(22) Filed: Jan. 17, 2007

(65) Prior Publication Data

US 2007/0187125 A1 Aug. 16, 2007

Related U.S. Application Data

(60) Provisional application No. 60/763,166, filed on Jan. 27, 2006.

(51) Int. Cl.
*B25D 15/00* (2006.01)

(52) U.S. Cl. ..... 173/162.1; 173/93; 173/93.5; 173/104; 173/210; 173/211; 464/77

(58) Field of Classification Search ..... 173/93, 173/93.5, 162.1, 104, 210, 211; 464/77
See application file for complete search history.

(56) References Cited

U.S. PATENT DOCUMENTS

| | | | | |
|---|---|---|---|---|
| 1,671,436 | A | | 5/1928 | Melott |
| 1,997,021 | A | | 4/1935 | Spase |
| 2,263,113 | A | | 11/1941 | Wichorek et al. |
| 2,285,638 | A | | 6/1942 | Amtsberg |
| 2,484,321 | A | | 10/1949 | Stubau |
| 2,520,920 | A | | 9/1950 | Fosnot |
| 2,716,334 | A | * | 8/1955 | Scott et al. ..... 464/73 |
| 3,174,559 | A | | 3/1965 | Vaughn |
| 3,179,219 | A | | 4/1965 | Karden |
| 3,183,684 | A | | 5/1965 | Zeidler |
| 3,232,362 | A | | 2/1966 | Cullen et al. |
| 3,533,479 | A | | 10/1970 | Madsen et al. |
| 3,552,499 | A | | 1/1971 | Maurer |
| 3,610,344 | A | | 10/1971 | Schoeps et al. |
| 3,661,217 | A | | 5/1972 | Maurer |
| 3,734,205 | A | | 5/1973 | Maurer |
| 3,746,330 | A | | 7/1973 | Taciuk |

(Continued)

*Primary Examiner*—Louis Huynh
*Assistant Examiner*—Michelle Lopez
(74) *Attorney, Agent, or Firm*—Wells St. John P.S.

(57) ABSTRACT

A shock attenuating coupling device is provided for a rotary impact tool for drivingly connecting a hammer mechanism to a drive anvil. The shock attenuating coupling device includes a first coupling member, a second coupling member, a drum, a shoe, and a body of resilient material. The first coupling member has a first drive portion. The second coupling member has a second drive portion. The drum is provided proximate the first drive portion and the second drive portion and has a radially inner engagement surface. The shoe is provided within the drum and between the first drive portion and the second drive portion. The shoe has a radially outer surface capable of being expanded in a radially outer direction. The body of resilient material is interposed between the drum and the shoe. The first drive portion and the second drive portion are configured to expand the shoe responsive to torsional displacement between the first coupling member and the second coupling member in order to compress the body of resilient material in engagement with the inner engagement surface of the drum.

21 Claims, 7 Drawing Sheets

U.S. PATENT DOCUMENTS 3,779,040 A 12/1973 Garrett
3,804,180 A 4/1974 Gelfand et al.
3,837,179 A * 9/1974 Barth ..... 464/76
3,866,746 A 2/1975 Curington
3,884,049 A 5/1975 Pauli
3,933,012 A 1/1976 Ketchum
3,939,670 A 2/1976 Amtsberg
4,106,779 A 8/1978 Zabcik
4,139,994 A 2/1979 Alther
4,228,664 A 10/1980 McCoy
4,313,505 A 2/1982 Silvern
4,322,062 A 3/1982 Aleck
4,347,902 A 9/1982 Wallace et al.
4,452,591 A 6/1984 Fishbaugh et al.
4,460,049 A 7/1984 Shibata
4,571,215 A 2/1986 Hansen
4,585,078 A * 4/1986 Alexandrov et al. ..... 173/93.5
4,627,885 A 12/1986 Arlt
4,650,027 A 3/1987 DeCortanze
4,702,338 A 10/1987 Trema
4,732,250 A 3/1988 Maucher et al.
4,779,852 A 10/1988 Wassell
5,038,884 A 8/1991 Kamiya et al.
5,199,505 A 4/1993 Izumisawa
5,217,409 A 6/1993 Dalbiez
5,224,898 A 7/1993 Johnson et al.
5,372,548 A 12/1994 Wohlfeld
5,622,230 A 4/1997 Giardino et al.
5,868,623 A 2/1999 Imanaka et al.
5,873,786 A 2/1999 Hosoya et al.
5,892,939 A 4/1999 Call et al.
5,954,552 A 9/1999 Lauterbach
6,047,779 A 4/2000 Wallace
6,144,891 A 11/2000 Murakami et al.
6,293,871 B1 9/2001 Geislinger
6,296,096 B1 10/2001 Chludek
6,446,735 B1 9/2002 Chen
6,464,017 B1 10/2002 Chen
6,484,859 B2 11/2002 Chludek
6,491,111 B1 12/2002 Livingston et al.
6,808,455 B1 10/2004 Solorenko et al.
2006/0225903 A1* 10/2006 Sterling et al. ..... 173/104
2006/0254786 A1* 11/2006 Murakami et al. ..... 173/109
2007/0158090 A1* 7/2007 Sterling et al. ..... 173/211

* cited by examiner

SHOCK ATTENUATING DEVICE FOR A ROTARY IMPACT TOOL

RELATED PATENT DATA

This application claims priority from U.S. Provisional Patent Application Ser. No. 60/763,166, which was filed Jan. 27, 2006, and which is incorporated by reference herein.

TECHNICAL FIELD

This invention pertains to rotary impact tools. More particularly, the present invention relates to rotary impact tools having a transient torque absorbing drive coupling provided intermediate a hammer mechanism and a drive anvil.

BACKGROUND OF THE INVENTION

Numerous designs are known for making rotary impact tools. U.S. Pat. Nos. 2,285,638; 3,661,217; and 6,491,111 disclose several variations of rotary impact tools having conventional rotary impact mechanisms. Such mechanisms are configured to deliver rotary forces via a series of transient impact blows which enables a human operator to handle the impact wrench while delivering relatively high torque forces in short duration impact blows. By applying relatively short duration high torque impact blows, a normal human being is rendered with the ability to physically hold onto the impact wrench while rendering the relatively high torque forces. If these forces were delivered in a continuous manner, a human operator would be required to impart an opposite continuous reaction force on the impact wrench which would prove to be too great for the operator.

One problem with the rotary impact tools mentioned above is the inability to deliver relatively high torque forces in short duration impact blows while reducing the peak transient forces generated at the instance of impact within the rotary impact mechanism.

Accordingly, it would be advantageous to control, or limit transmission of peak transient forces that are generated via a rotary impact mechanism of a rotary impact tool to an anvil.

SUMMARY OF THE INVENTION

A shock attenuating coupling device is provided for use on a rotary impact tool between an impact mechanism and an anvil. A resilient member is configured to interact between a drive shaft and a driven shaft in order to provide a resilient rotary coupling device interposed between a hammer mechanism and a drive anvil. In one case, a compression band is provided between a drum and a shoe assembly on a first coupling member of the drive shaft and a second coupling member of the driven shaft, respectively. In this case, the impact mechanism can take on any known form including a single (or double) swing weight hammer mechanism, as well as a twin pin (or twin cock) hammer mechanism. In such cases, the resilient rotary coupling device is configured to attenuate impacts from the hammer mechanism to the drive anvil. In one case, the impact mechanism is a rotary impact mechanism.

According to one aspect, a shock attenuating coupling device is provided for a rotary impact tool for drivingly connecting a hammer mechanism to a drive anvil. The shock attenuating coupling device includes a first coupling member, a second coupling member, a drum, a shoe, and a body of resilient material. The first coupling member has a first drive portion. The second coupling member has a second drive portion. The drum is provided proximate the first drive portion and the second drive portion and has a radially inner engagement surface. The shoe is provided within the drum and between the first drive portion and the second drive portion. The shoe has a radially outer surface capable of being expanded in a radially outer direction. The body of resilient material is interposed between the drum and the shoe. The first drive portion and the second drive portion are configured to expand the shoe responsive to torsional displacement between the first coupling member and the second coupling member in order to compress the body of resilient material in engagement with the inner engagement surface of the drum.

According to another aspect, a rotary impact tool is provided having a housing, a hammer mechanism, a drive anvil, and a resilient rotary coupling device has at least one shoe, a drum, and a body of resilient material. The at least one shoe has a radially outer surface configured to be expanded in a radially outer direction. The drum has a radially inner engagement surface. The body of resilient materials is interposed between the drum and the shoe. One of the drums,in the shoe is configured to be driven by the hammer mechanism. Another of the drums in the shoe is configured to be driven by the drive anvil. The resilient rotary coupling device is interposed between the hammer mechanism and the drive anvil and is configured to attenuate impact from the hammer mechanism to the drive anvil.

According to yet another aspect, a shock attenuating device is provided for a rotary impact tool. The shock attenuating device has a hammer shank, a drive shaft, a housing, a compression member, and an expandable shoe. The hammer shank has a first coupling member. The drive shaft has a second coupling member. The housing encompasses the first coupling member and the second coupling member. The compression member is provided within the housing. The expandable shoe is provided within the compression member and is configured to be engaged by the first coupling member and the second coupling member to expand the shoe radially outwardly responsive to torsional displacement between the hammer shank and the drive shaft.

BRIEF DESCRIPTION OF THE DRAWINGS

Preferred embodiments of the invention are described below with reference to the following accompanying drawings.

FIG. 4 is an enlarged partial view, shown in partial vertical centerline cross-section, of a pneumatic valve, pneumatic motor, rotary impact mechanism, shock attenuating coupling device, and anvil for the rotary impact tool of FIGS. 1-3.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to several embodiments of Applicants' invention for a rotary impact tool having a shock attenuating coupling device between an impact mechanism and an anvil. While the invention is described by way of a preferred embodiment, it is understood that the description is not intended to limit the invention to such embodiment, but is intended to cover alternatives, equivalents, and modifications which may be broader than the embodiment, but which are included within the scope of the appended claims.

In an effort to prevent obscuring the invention at hand, only details germane to implementing the invention will be described in great detail, with presently understood peripheral details being incorporated by reference, as needed, as being presently understood in the art.

FIGS. 1-11 illustrate a rotary impact tool in the form of a pneumatic impact wrench 10 according to one aspect of the present invention. More particularly, impact wrench 10 is provided with a resilient rotary coupling device 12 (see FIGS. 3-10) that is provided between an impact mechanism, or hammer 14, and an anvil 16. According to one construction, the resilient coupling device provides resilient or shock-attenuating rotational coupling in a forward direction, but provides no resilience in an opposite, reverse direction. Hence, when used in a torque wrench, the resilient coupling device limits peak transient impact loads being generated from the wrench and transferred to the anvil when tightening a fastener with a drive socket (not shown) that is provided on the anvil. However, the torque wrench generates greater peak transient impact loads when operated in a reverse, or loosening direction, which ensures that greater forces are generated for loosening a secured fastener.

Figure 1:
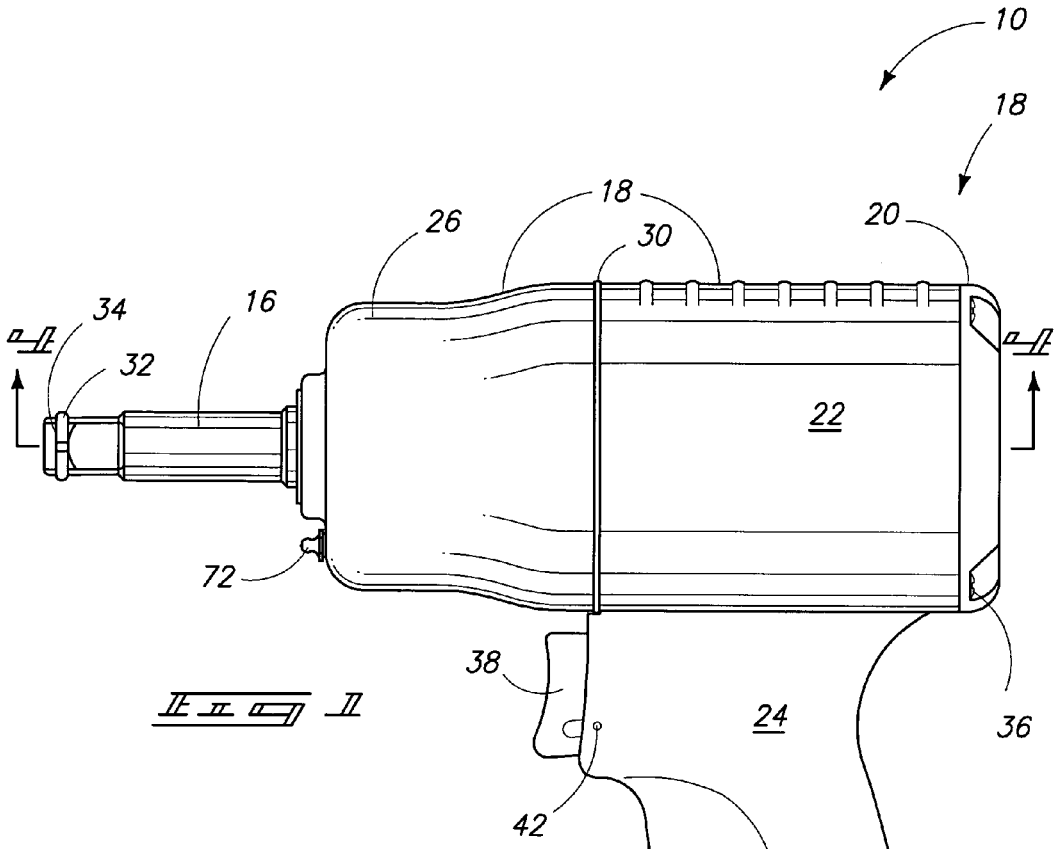
FIG. 1 is a side elevational view of a rotary impact tool having a shock attenuating coupling device interposed between a rotary impact mechanism and an anvil in accordance with one embodiment of the present invention.

As shown in FIG. 1, wrench 10 has a tool housing 18 comprising a motor housing member 20 and a hammer housing member, or nose piece, 26. Motor housing member 20 includes a hollow motor casing 22 and an integrally formed handle 24. Optionally, handle 24 can be formed from a separate piece that is fastened onto casing 22. A resilient front gasket 30 is provided between members 20 and 26 via four screws 36. Anvil 16 terminates at a distal end with an anvil collar 32 provided about a resilient o-ring 34 within a recess about anvil 16. Anvil collar 32 is urged in compression in a radially-inward direction when retaining and releasing an impact socket, or tool from anvil 16.

Handle 24 of impact wrench 10 includes a trigger 38 that is guided for compression and release via a force-fit spring pin 42, as shown in FIG. 1. Additionally, a grease fitting 72 is provided on housing member 26 to enable application of grease to internal components of impact wrench 10. Another spring pin 44 is provided in handle 24 to anchor air inlet fitting, or member, 60.

Figure 2:
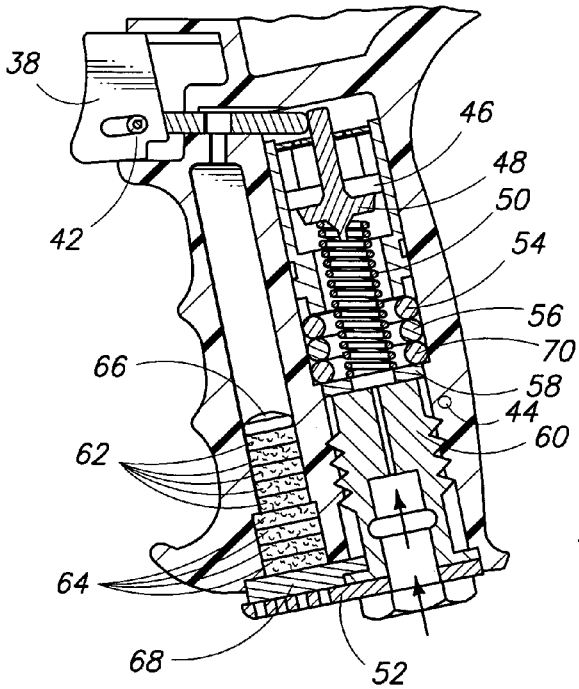
FIG. 2 is an enlarged partial view, shown in vertical centerline cross-section, of an air supply, trigger mechanism, and muffler provided in a handle of the rotary impact tool of FIG. 1.
Figure 2:
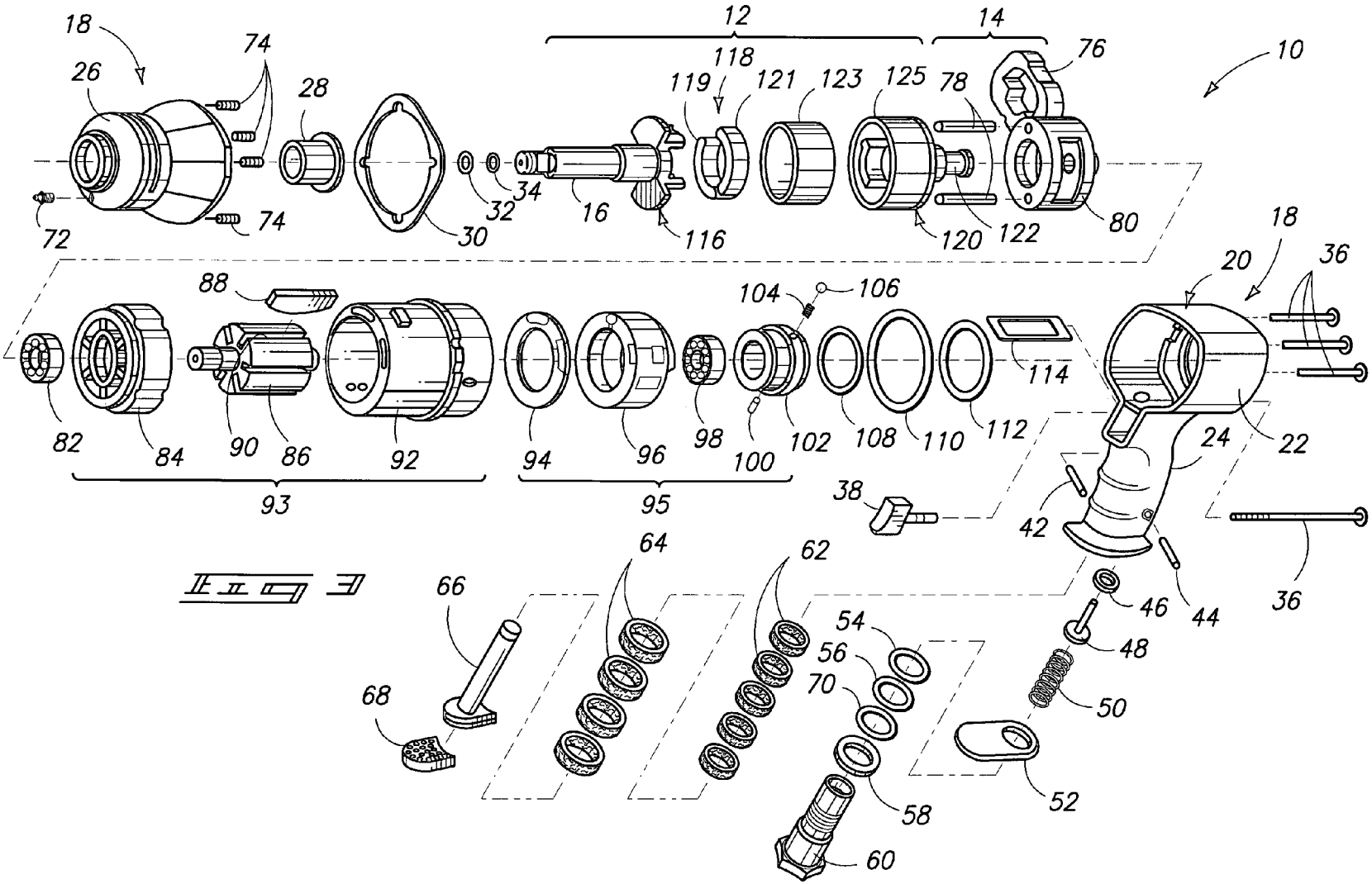
Figure 3:
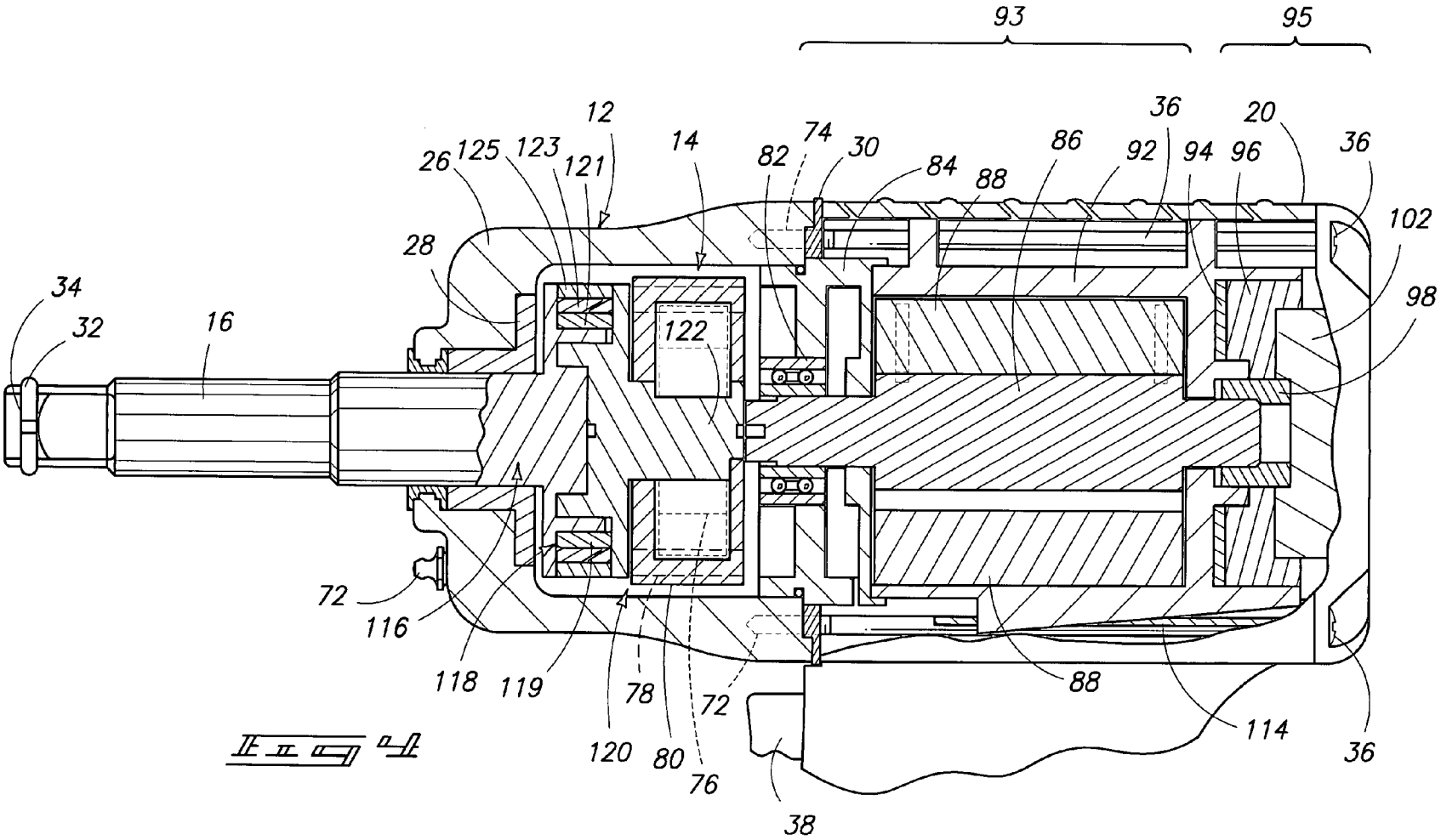
FIG. 3 is a simplified, exploded perspective view of the rotary impact tool of FIGS. 1-2.

FIG. 2 illustrates assembly of an air supply, trigger mechanism, and muffler within handle 24 of impact wrench 10 of FIG. 1. More particularly, a trigger mechanism is provided by trigger 38 which acts via pin 42 to move and tilt a valve stem 48 relative to a bushing 46 while acting against a coil seat spring 50. When depressed, trigger 38 moves valve stem 48 to an open, unsealed position relative to bushing 46 to deliver air from a source into the impact wrench. The trigger mechanism includes o-rings 54, 56, and 70 seated against a washer 58 atop an air inlet member 60 configured to receive air from an air supply such as a pressurized air line (not shown). A muffler is provided within handle 24 by two stacks of wool felt rings 62, 64 each configured with a ring-shape for mounting about an exhaust tube 66. Exhaust air from the impact wrench is received through felt rings 62, 62, tube 66 and through a muffler 68 where it exists handle 24 via a plurality of apertures in an exhaust deflector 52. FIG. 3 further illustrates these features, along with additional construction details, as discussed below.

FIG. 3 further illustrates component assembly of pneumatic impact wrench 10 of FIGS. 1-2. More particularly, housing member 20 is joined to housing member 26 using screws 36 (several shown in partial breakaway view) which thread into complementarily threaded insert pieces 74 that are threaded into member 20. Anvil 16 of resilient rotary coupling device 12 is received for rotation through an anvil bushing 28 within member 26. Device 12 is directly joined to impact mechanism 14. Impact mechanism 14 comprises a single hammer construction having a hammer 76, a pair of hammer pins 78, and a hammer cage 80. Hammer cage 80 is mounted for rotation onto a pneumatic motor 93 which drives cage 80 in rotation to generate impacts between hammer 76 and a hammer shank 122. An air valve 95 enables adjustment of air supply to motor 93 to vary operating parameters for impact wrench 10.

Motor 93 includes a front end plate 84, a rotor 86, a plurality of rotor blades 88, and a cylinder 92. Each blade 88 is received in a respective slot 90 provided in circumferentially spaced-apart positions along rotor 86. End plate 84 receives a ball bearing assembly 82 that supports a front end of rotor 90. Cylinder 92 also receives a valve sleeve gasket 94 and a valve sleeve 96. Valve sleeve 96 receives a ball bearing assembly 98 that supports a back end of rotor 86. A reverse valve 102, an o-ring 108, a rear gasket 110, and a washer 112 are assembled between valve sleeve 96 and motor casing 22. Reverse valve 102 supports a spring pin 100, a spring 104 and a steel ball 104. An air channel gasket 114 is also mounted within motor casing 22.

According to one embodiment of the present invention, resilient rotary coupling device 12 comprises a jaw portion 116, a compression ring spring assembly 118, and another jaw portion 120. Jaw portion 120 is directly coupled to a hammer shank 122 which is driven via intermittent impacts with hammer 76 due to rotation of cage 80 via motor 93. In operation, anvil 16 receives an impact socket that is coupled to a fastener. With each impact, jaw portion 120 is driven in rotation. As anvil 16 meets greater resistance due to a tightening fastener, jaw portion 116 resists rotation while jaw portion 120 continues to be loaded from torsional, transient impacts. Spring assembly 118 flexes torsionally under such conditions so as to attenuate peak impact force transmission between the hammer impact mechanism 14 and the anvil 16. Spring assembly 118 provides the characteristics of a shock attenuating coupling device within the rotary impact tool, or impact wrench, 10.

Jaw portion 116 is provided as part of a second coupling member and jaw portion 120 is provided as part of a first coupling member. The first coupling member has a longitudinal drive portion with an input end configured to couple for rotation with a hammer mechanism 14 and an output end with a first jaw portion 120. The second coupling member has an output end configured to couple for rotation with a drive anvil 16 and an input end with a second jaw portion 116 configured to cooperate in longitudinally overlapping and circumferentially spaced-apart relation. Spring assembly 118 provides a body of resilient material, or compression band 123 that is interposed between a drum 125 and a shoe assembly 119, 121. The first jaw portion 120 and the second jaw portion 116 cooperate with shoe assembly 119, 121 to drive apart individual shoes 119 and 121 so as to compress compression band 123 in a radial outer direction against a radial inner engagement surface of drum 125. Accordingly, compression band 123 cooperates with shoes 119, 121 and drum 125 to provide a torsional spring when a wrench is driven in a forward drive direction.

FIG. 4 illustrates in assembly the components of impact wrench 10, including resilient rotary coupling device 12. More particularly, coupling device 12 is shown assembled between impact mechanism 14 and anvil 16. Additionally, motor 93 and air valve 95 are also shown. Except for the new and novel features of resilient rotary coupling device 12, the remaining features of wrench 10 are presently known in the art. An impact wrench with these remaining features is presently sold commercially as a ½" composite impact wrench, but with a twin hammer, as a Model #1000$^{TH}$, Aircat impact wrench, from Exhaust Technologies, Inc., North 230 Division, Spokane, Wash. 99202. Further details of an alternative construction for a twin hammer mechanism are disclosed in U.S. Pat. No. 6,491,111, herein incorporated by reference. With respect to the alternative hammer construction depicted in the embodiment of FIGS. 11-12, U.S. Pat. No. 3,414,065 discloses a typical construction for a twin-pin hammer, or clutch, assembly, herein incorporated by reference.

Figure 5:
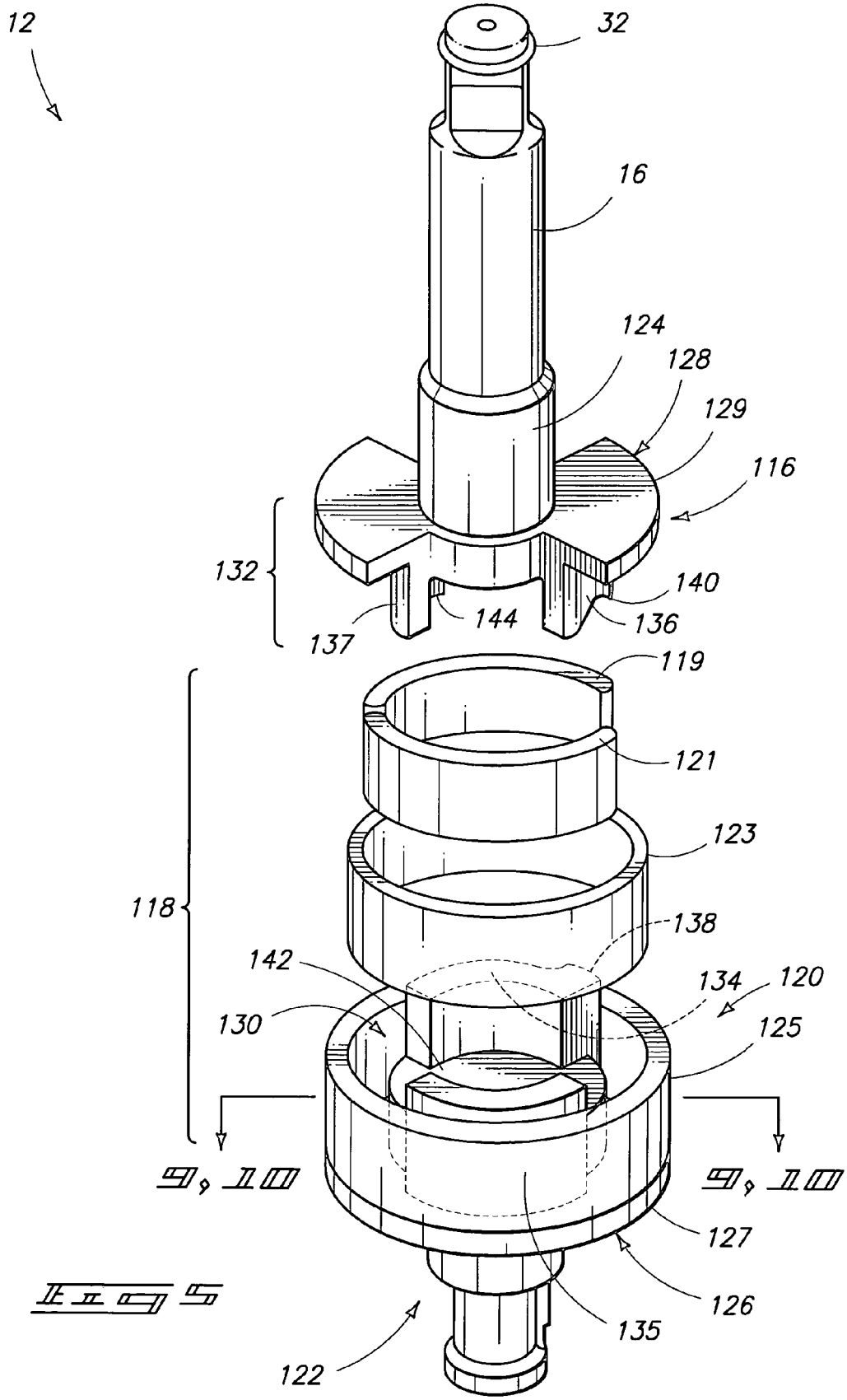
FIG. 5 is an enlarged, exploded and perspective view of the shock attenuating coupling device of FIG. 4.

FIG. 5 illustrates resilient rotary coupling device 12 in an exploded perspective view to better show cooperation between jaw portion 116, compression ring spring assembly 118, and jaw portion 120. This cooperation provides rotational compliance, or spring deformation between hammer shank 122 and anvil 16. Jaw portion 120 is provided on a first coupling member 126 that is directly affixed onto a hammer shank 122. Hammer shank 122 drives first coupling member 126 in response to hammer impacts from hammer 14 (see FIGS. 3-5).

First coupling member 126 includes a drive pawl 134, a guide pawl 135, and a cylindrical base portion 142 which cooperate to provide a first torsional coupling member 130. Drive pawl 134 includes a drive finger, or dog leg, 138. Pawls 134, 135 and base portion 142 extend integrally from a drive plate 127 to form first coupling member 126. According to one construction, pawls 134, 135, base portion 142, plate 127 and hammer shank 122 are machined from a single piece of 8260 case hardened steel.

Second coupling member 128 includes a driven pawl 136, a guide pawl 137, and a cylindrical recess 144 that overlaps with a cylindrical outer portion of base portion 142, in assembly, which cooperate to provide a second torsional coupling member 132. Driven pawl 136 includes a driven finger, or dog leg, 140. Pawls 136, 137 extend integrally from a driven plate 129 to form second coupling member 128. According to one construction, pawls 136, 137, driven plate 129, enlarged shaft 124, and anvil 16 are machined from a single piece of 8260 case hardened steel.

According to one construction, spring assembly 118 includes a drum, or housing band 125 having a radially inner engagement surface inside of which a compression band 123 of resilient or elastomeric material is received. According to one construction, compression band 123 is constructed from a single, cylindrical piece of resilient material, such as Duralast® Nylon®, rubber, or some other resilient and/or elastomeric material. Spring assembly 118 also includes a shoe assembly, comprising a pair of shoes 119 and 121, having a radially outer surface capable of being expanded in a radially outer direction. Free ends of each shoe 119 and 121, provided along a gap, are driven open by fingers 136 and 138 which causes the shoes to move in a radially outer direction and compression band 123 within drum 125. Opposite ends of shoes 119 and 121 contact together to form a pivot point.

According to one construction, shoes 119 and 121 are constructed from a single piece of 5160 spring steel that is sized to snugly fit, in assembly, about pawls 134, 135, 136, and 137, between fingers 138 and 140, and within band 123. In assembly, shoes 119 and 121 have an open slit, or mouth portion, that urges fingers 138 and 140 together, in assembly. Chambers on the open ends of shoes 119 and 121 facilitate assembly. Details of the unloaded assembly configuration are shown and described in reference to FIG. 9 below. Transient rotation impact forces cause rotation between coupling members 126 and 128 which causes fingers 136 and 138 to rotate further apart, thereby forcibly biasing further apart the open slit, or gap between shoes 119 and 121. This forces shoes in a radially outward direction to compress compression band 123 against a radially inner engagement surface of drum (or compression band) 125. In this manner, spring assembly 118 provides compliance between coupling members 126 and 128 which mitigates the transfer of peak transient impact forces from hammer shank 122 to anvil 16. According to optional constructions, shoes 119 and 121 can be laminated from multiple components such as a radial inner c-shaped spring and a radial outer c-shaped spring, or from multiple c-shaped springs that are laminated together along a common axis, next to one another. Further optionally, shoes 119 and 121 can be constructed from any form of spring material including spring metals and composites, such as fiberglass or carbon fiber composite. Even further optionally, shoes 119 and 121 can be formed from hardened steel so as to have little or no spring characteristics.

Figure 6:
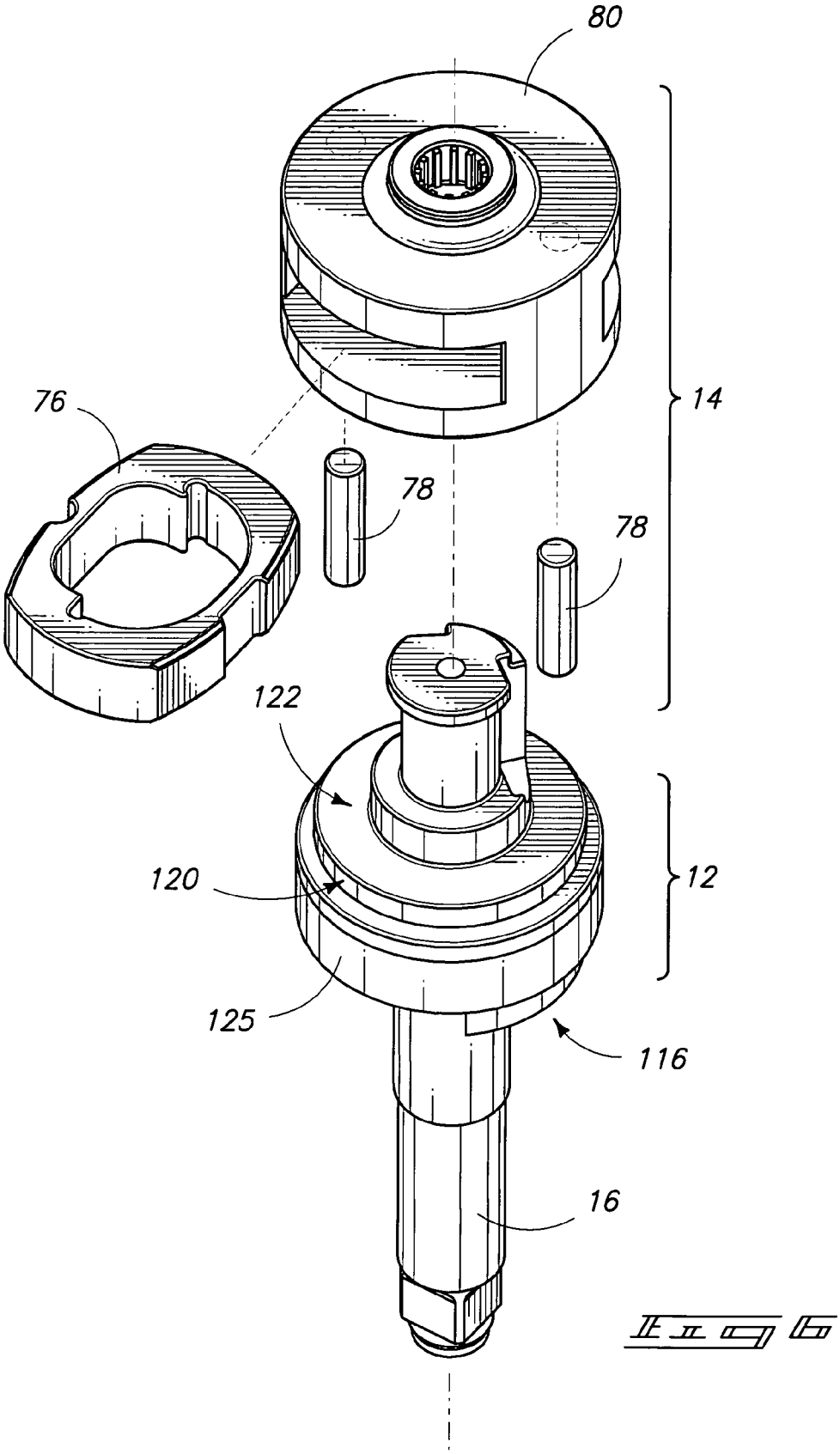
FIG. 6 is an enlarged, partially exploded and perspective view of the shock attenuating coupling device, anvil, and hammer for the rotary impact tool of FIGS. 1-4.

FIG. 6 illustrates resilient rotary coupling device 12 in an assembled-together configuration along with hammer impact mechanism 14 which is shown in an exploded perspective view. Resilient rotary coupling device 12 is shown affixed to anvil 16. Hammer 76 is supported for pivot movement about one of pins 78, which imparts impact between an inner surface of hammer 76 and a corresponding surface on hammer shank 122. The remaining pin 78 limits pivotal movement of hammer 76 an impact cycle. Hammer cage 80 is driven in rotation via an internal spline that couples with an external spline on the rotary air motor. First jaw portion 116 is coupled in resilient rotational relation with second jaw portion 120 via c-shaped spring 118.

Figure 7:
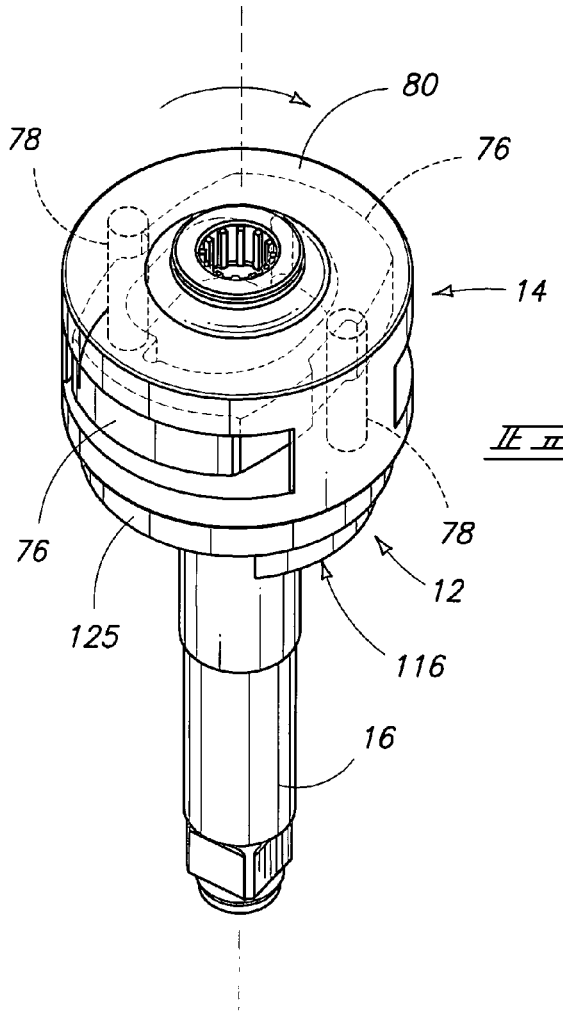
FIG. 7 is an enlarged, perspective view of the shock attenuating coupling device, anvil, and hammer of FIG. 6 in an assembled state and illustrating the single swing weight hammer assembly with the swing weight in a first position.
Figure 8:
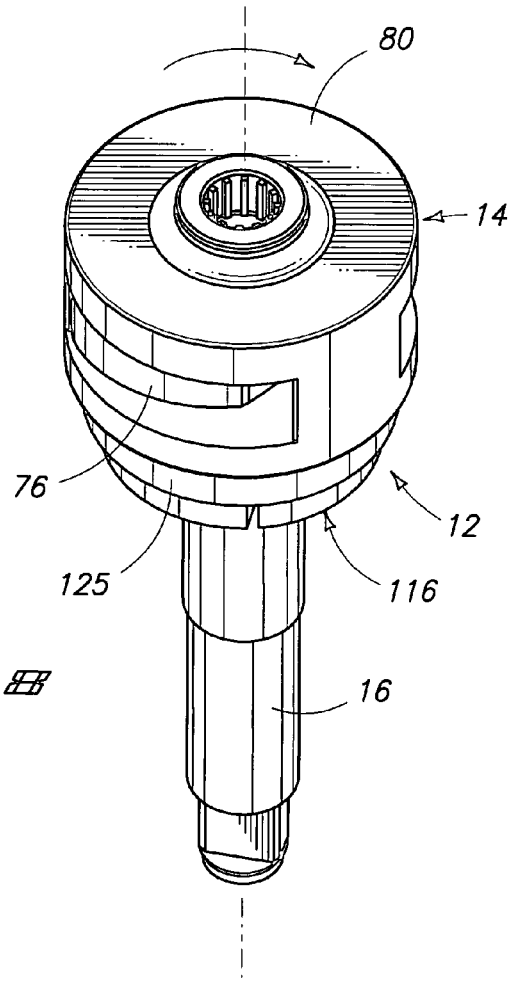
FIG. 8 is a an enlarged, perspective view of the shock attenuating coupling device, anvil, and hammer of FIG. 7 in an assembled state and illustrating the single swing weight hammer assembly with the swing weight in a second position.

Resilient rotary coupling device 12 is shown assembled together with hammer 14 in FIG. 7. Hammer 76 is shown in a position just prior to impact with a hammer surface on hammer shank 122 (see FIG. 6). Hammer 76 is shown later in time in FIG. 8 just after impact with the hammer surface on the hammer shank, which causes hammer 76 to pivot.

Figure 9:
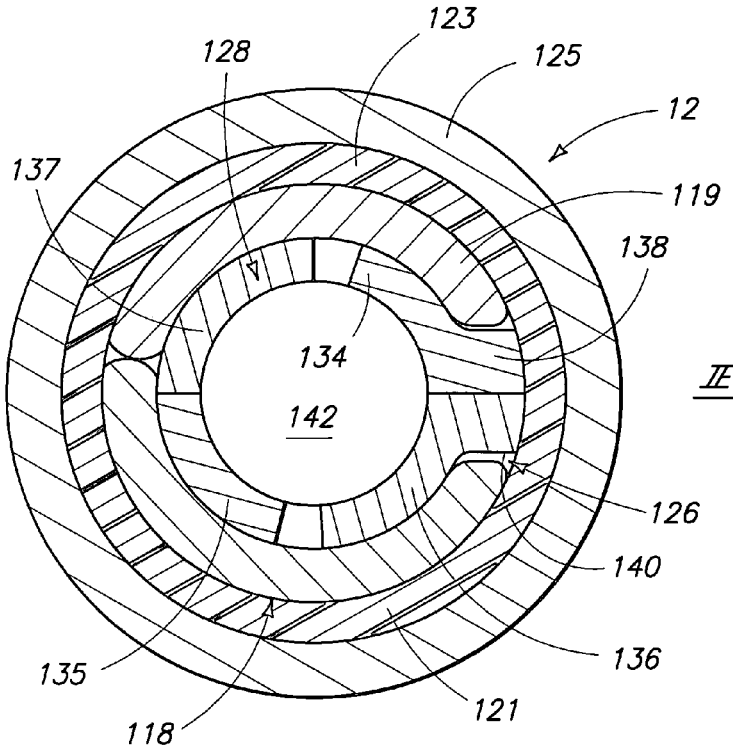
FIG. 9 is a cross-sectional view of the shock attenuating coupling device taken along line 9-9 of FIG. 5 illustrating the device prior to being torsionally loaded with an impact from an impact hammer.

FIG. 9 depicts resilient rotary coupling device 12 as assembled together without any impact load on spring assembly 118. Spring assembly 118 is sized to snugly assemble together about pawls 134-137 and in engagement with drive finger 138 and driven finger 140. In this configuration, a ten degree gap is provided between paws 134, 137 and pawls 135, 136.

Figure 10:
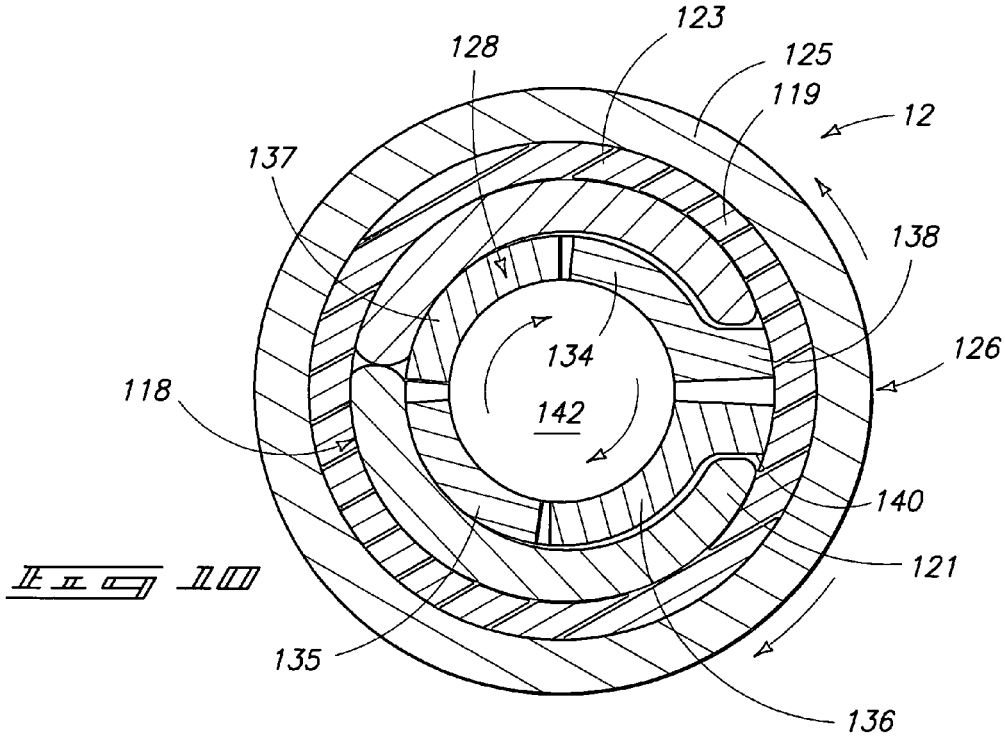
FIG. 10 is a cross-sectional view of the shock attenuating coupling device of FIG. 9 taken along line 10-10 of FIG. 5 and illustrating the device when torsionally loaded into a compliant displacement position with an impact from an impact hammer.

FIG. 10 depicts resilient rotary coupling device 12 while under an impact load from an impact hammer which causes spring assembly 118 to flex into a more open position as drive finger 138 and driven finger 140 forcibly urge apart the slit, or gap between shoe 119 and 121. Accordingly, spring assembly 118 provides sufficient compliance for pawls 134, 135 of first coupling member 126 to rotate five degrees relative to pawls 136, 137 of second coupling member 128. After the transient impact, spring assembly 118 recompresses to force first coupling member 126 and second coupling member 128 back into the positions depicted in FIG. 9.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A shock attenuating coupling device for a rotary impact tool for drivingly connecting a hammer mechanism to a drive anvil, comprising:

a first coupling member having a first drive portion;

a second coupling member having a second drive portion;

a drum provided proximate the first drive portion and the second drive portion and having an inner surface;

a shoe provided within the drum and between the first drive portion and the second drive portion and having an outer surface capable of being expanded in an outer direction; and a body of resilient material interposed between the drum and the shoe;

wherein the first drive portion and the second drive portion are configured to expand the shoe responsive to torsional displacement between the first coupling member and the second coupling member to compress the body of resilient material in engagement with the inner surface of the drum.

2. The shock attenuating coupling device of claim 1 wherein the shoe is formed from a first shoe member and a second shoe member that are pivotally engaged together in a generally circular form and each having an outer engagement surface.

3. The shock attenuating coupling device of claim 2 wherein the first drive portion comprises a first drive pawl and the second drive portion comprises a second drive pawl.

4. The shock attenuating coupling device of claim 3 wherein the first drive pawl engages with a free end of the first shoe member and the second drive pawl engages with a free end of the second shoe member.

5. The shock attenuating coupling device of claim 1 wherein the body of resilient material comprises a spring.

6. The shock attenuating coupling device of claim 5 wherein the spring comprises a cylindrical compression band formed of resilient elastomeric material.

7. The shock attenuating coupling device of claim 1 wherein the drum comprises a cylindrical housing member of rigid material having a cylindrical inner surface configured to receive the body of resilient material.

8. The shock attenuating coupling device of claim 7 wherein the body of resilient material comprises a cylindrical band of resilient material configured to be received within the cylindrical housing.

9. The shock attenuating coupling device of claim 1 wherein the shoe comprises at least one arcuate segment of spring steel configured to be received within the body of resilient material and the inner surface of the drum.

10. A rotary impact tool, comprising:

a housing;

a hammer mechanism;

a drive anvil; and a resilient rotary coupling device having at least one shoe with an outer surface configured to be expanded in an outer direction, a drum having an inner surface, and a body of resilient material interposed between the drum and the shoe, one of the drum and the shoe configured to be driven by the hammer mechanism and another of the drum and the shoe configured to be driven by the drive anvil, and the resilient rotary coupling device interposed between the hammer mechanism and the drive anvil and configured to attenuate impacts from the hammer mechanism to the drive anvil.

11. The rotary impact tool of claim 10 further comprising a first coupling member with a first drive portion coupled with the hammer mechanism and a second coupling member having a second drive portion coupled with the drive anvil.

12. The rotary impact tool of claim 11 wherein the first drive portion and the second drive portion cooperate to expand the shoe in an outer direction.

13. The rotary impact tool of claim 10 wherein the at least one shoe comprises a pair of shoes assembled together into a generally circular form and having an outer engagement surface.

14. The rotary impact tool of claim 13 wherein a gap is provided between the shoes at a first end and a pivot point is provided between the shoes at a second end.

15. The rotary impact tool of claim 10 wherein the body of resilient material comprises a cylindrical band of elastomeric material.

16. A shock attenuating device for a rotary impact tool, comprising:

a hammer shank with a first coupling member;

a drive shaft with a second coupling member;

a housing encompassing the first coupling member and the second coupling member;

a compression member provided within the housing; and an expandable shoe provided within the compression member and configured to be engaged by the first coupling member and the second coupling member to expand the shoe outwardly responsive to torsional displacement between the hammer shank and the drive shaft.

17. The shock attenuating device of claim 16 wherein the housing comprises a rigid, cylindrical band.

18. The shock attenuating device of claim 16 wherein the compression member comprises a cylindrical band of elastomeric material.

19. The shock attenuating device of claim 16 wherein the expandable shoe comprises a pair of coacting shoes.

20. The shock attenuating device of claim 16 wherein the compression member comprises resilient material.

21. The shock attenuating device of claim 20 wherein the resilient material comprises an elastomeric material.

* * * * *